US005248084A

United States Patent [19]

Latarius

[11] Patent Number: 5,248,084

[45] Date of Patent: Sep. 28, 1993

[54] APPARATUS AND METHOD FOR CONTROLLING THE WATER FLOW RATE FROM THE BOILER CIRCUIT TO THE HEATING CIRCUIT IN HOT WATER HEATING SYSTEMS

[75] Inventor: Hans Latarius, Essen, Fed. Rep. of Germany

[73] Assignee: Tekmar Angewandte Elektronik GmbH, Fed. Rep. of Germany

[21] Appl. No.: 807,834

[22] PCT Filed: May 21, 1991

[86] PCT No.: PCT/EP91/00946

§ 371 Date: Jan. 15, 1992

§ 102(e) Date: Jan. 15, 1992

[87] PCT Pub. No.: WO91/18246

PCT Pub. Date: Nov. 28, 1991

[30] Foreign Application Priority Data

May 19, 1990 [DE] Fed. Rep. of Germany ..... 4016221

[51] Int. Cl.[5] ..... F24D 3/00

[52] U.S. Cl. ..... 237/8 C; 137/625.13

[58] Field of Search ..... 237/8 R, 8 B, 8 C, 59; 236/9 A; 137/339, 625, 625.12, 625.13, 625.14, 625.15, 625.18, 625.29

[56] References Cited

FOREIGN PATENT DOCUMENTS 3207427 9/1983 Fed. Rep. of Germany ..... 237/8 C

*Primary Examiner*—Henry A. Bennett

*Attorney, Agent, or Firm*—Blakely, Sokoloff, Taylor & Zafman

[57] ABSTRACT

The volume of water in circulation is controlled by means of a bell-type mixer (4) which has a stationary section disc (6) and a somewhat sickle-shaped rotary distributor bell (7). The section disc has at least three separate passage openings, the first of which is connected with the boiler feed pipe (KV), the second (12) with the heating pipe (HV) and the third with the boiler return pipe. The distributor bell (7) is acted upon externally by the heating return water pressure and internally housing a communication duct (19). The distributor bell shunts the boiler feed pipe over a limited area of rotation via the second passage opening (12) with the heating pipe and simultaneously frees a variable area of the opening into the second passage for the admixture of return water. In this way optimal regulation is achieved with little structural, maintenance or operational outlay.

25 Claims, 3 Drawing Sheets

Fig. 4A
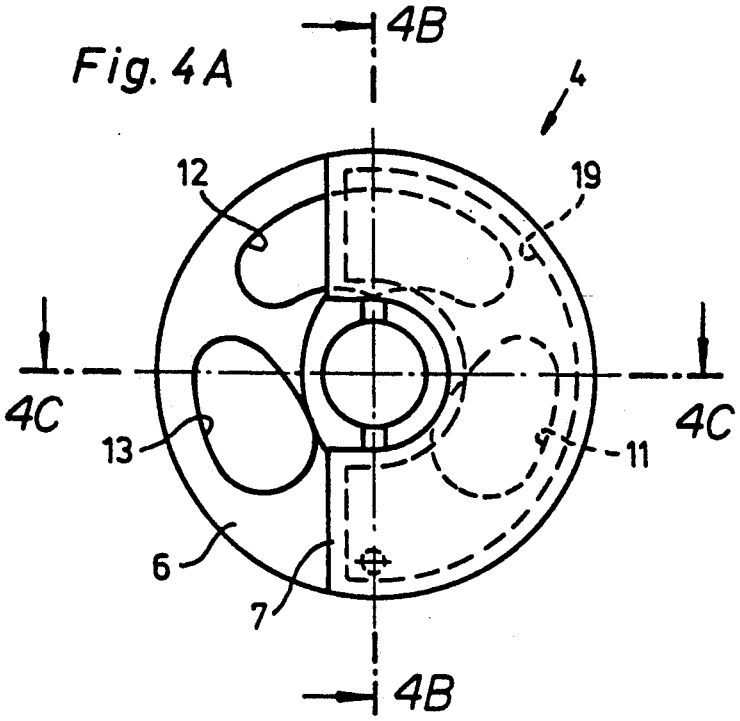
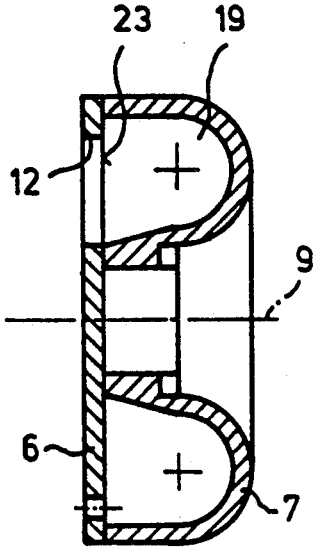
Fig. 4B
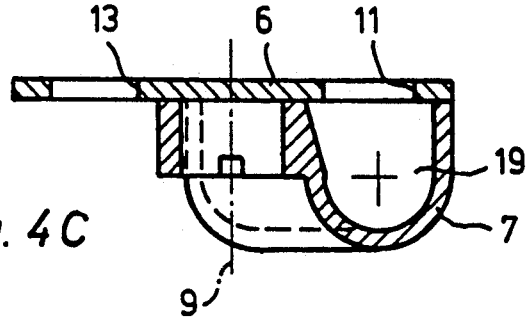
Fig. 4C
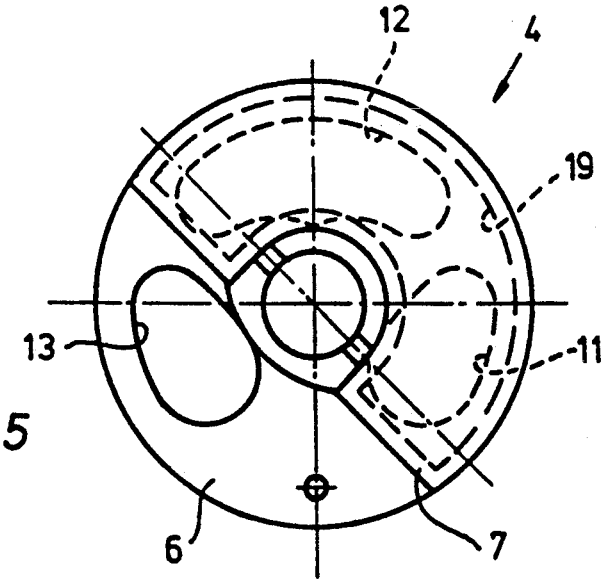
Fig. 5

APPARATUS AND METHOD FOR CONTROLLING THE WATER FLOW RATE FROM THE BOILER CIRCUIT TO THE HEATING CIRCUIT IN HOT WATER HEATING SYSTEMS

The invention relates to an apparatus and a method for controlling the water flow rate from the boiler circuit to the heating circuit in hot water heating systems, particularly of low temperature type, with a four-way mixer and a control device controlling the position thereof which is so constructed that when the mixer is fully open it enables a variable amount of the returned water to be added into the heater supply. The invention further relates to a particular construction of four-way mixer for use in such an apparatus or such a method.

When using conventional mixers in low temperature heaters the maximum necessary supply temperature of 50° C. is reached at a boiler temperature of 80° C. at substantially less than half the mixer control travel. Too coarse a control characteristic was thus produced. Furthermore, it is a requirement of low temperature heaters, particularly floor heaters, that different volumes of water be transported into the pipe circuits of the boiler on one hand and the heater on the other hand. A calculated example of this is:

(A) typical temperatures in the boiler circuit are

Boiler supply = 80° C.

= difference 20K

Boiler return = 60° C.

(B) typical temperatures in a floor heating circuit are

Supply = 40° C.

= difference 10K

Return = 30° C.

The following water volume requirements are produced at an assumed heat requirement of 20,000 kcal:

$$\text{for } A)\ \frac{20{,}000\,kcal}{20K} = 10001/h$$

$$\text{for } B)\ \frac{20{,}000\,kcal}{10K} = 20001/h$$

A conventional mixer is not capable of fulfilling these requirements. For this reason an appropriately dimensioned bypass connection has generally been provided between the heater supply and return. A constant amount of returned water was thus continuously fed to the supply independent of the position of the mixer with the advantage that the water volume in the heater circuit was thus increased and the angular control range of the mixer made use of.

The disadvantage of such control devices is that when the desired value changes the heating system reacts very sluggishly.

An apparatus and a method of the generic type are known from DE-C 3207427. The extent of the control range which is in practice available and the desired rapid control response, for instance with a thermal shift after the night-time reduction, are achieved by means of an adjustable bypass which is controlled in dependence on the mixer position and is substantially closed when the mixer path from the boiler supply to the heater supply is fully open. The adjustable bypass mixes an additional volume of returned water into the volume of hot water which flows through the multiway mixer. When the mixer is somewhat closed due to the supply temperature limitation, the volume of returned water fed through the bypass increases. The volume of boiler supply water flowing to the heater supply via the mixer path can thus remain substantially undiminished so that the mixer guarantees a sensitive control performance even in the upper control range. The association of a control bypass with a conventional multiway mixer and the provision of a control linkage therebetween was previously the only possibility for combining the desired control performance with small dead periods, relatively short transition phases and substantial useage of the mixer control range. The additional controlled bypass flap increases the manufacturing and maintenance expense, particularly since the wear in the two pathways via the mixer on the one hand and via the bypass on the other hand is not always uniform and homogeneous.

It is the object of the invention to optimise the desired control performance described above and to achieve it with substantially reduced constructional, maintenance and operational expense.

In order to solve this object the apparatus in accordance with the invention is characterised in that the four-way mixer is constructed as a cap mixer with a stationary profiled disc and a rotatable control cap, whereby the control cap is arranged with a sealing surface sliding on a preferably flat seating surface of the profiled disc; that the profiled disc is provided with at least three separate openings, of which a first is connected to the boiler supply, a second is connected to the heater supply and a third is connected to the boiler return; that the control cap is arranged in a flow chamber, which is connected to the heater return, whose outer surface is acted on by the pressure of the heater return water, whose inner surface defines a connecting passage, extends over an angular region of the profiled disc and over a limited range of rotational positions short circuits (fully open mixer) the first opening connected to the boiler supply with the second opening leading to the heater supply and simultaneously exposes a variable proportion of the opening cross-section of the second opening to the flow chamber connected to the heater return (HR) for the addition of returned water.

Surprisingly, the invention results in a sensitive control performance over the entire mixer control range with the omission of a control bypass simply by a particular construction of the mixer itself. Instead of a separate bypass, the connecting passage in the control cap renders possible the supply of the maximum amount of boiler supply water with a variable amount of returned water. Thus even in the upper control range a sensitive control can be achieved by changing the volume of returned water. The expensive provision of an adjustable bypass and the linking thereof to the position transmitter of the mixer by means of a control circuit are omitted.

In operation, the forces acting on the control cap due to the returned water pressure are sufficient to achieve a sealed engagement of the control cap with its flat seating surface on the profiled disc; preferably, however, the control cap is resiliently biased with a small force against the profiled disc.

In a further embodiment of the invention the openings have at least partially kidney-shaped opening cross-sections in order to achieve the optimum control performance. The second .opening connected to the heater supply is preferably substantially larger than the two other openings in the profiled disc in order that the necessary flow cross-sections into the heater supply are available, not only for the inflow of the boiler supply water but also of a proportion of the heater return water.

The profiled disc preferably consists of abrasion- and/or corrosion- resistant material, particularly hardened or alloyed steel, and/or ceramic material. On the other hand, the control cap preferably consists of softer material, particularly plastics material, and can be constructed as an injection moulded component The stated material combination alloyed steel/plastic/plastic material for the profiled disc and the control cap has particular advantages. On the one hand, an easy rotation of the control cap, particularly between these types of materials, is ensured. This easy movability enables low powered actuators to be used. Both materials have excellent resistance (no corrosion, no dezincking). There is scarcely any wear since a flat sealing surface on the control cap slides on a flat seating surface on the profiled disc and the spring loading of the control cap is low. Only the control cap is abraded; this, however, does not alter the seal between the two components (profiled disc and control cap) which are maintained in operative connection since abrasion is automatically resiliently adjusted for. The cross-section of the connecting passage is of course so large that the corresponding adjustment movement on abrasion of the control cap has no harmful effect on the flow cross-section. The constructional and mechanical expense is significantly reduced in the apparatus in accordance with the invention in comparison to the mixer-bypass combination of the generic type. The service life of the new apparatus is accordingly also substantially larger; it is to be expected that the service life of the cap mixer in accordance with the invention will correspond to that of the associated heating installations (25–30 years).

Further convenient embodiments of the apparatus in accordance with the invention will be apparent from the dependent claims.

The method in accordance with the invention for operating the control arrangement is characterised in that after a suddenly increased heat requirement the control cap is firstly rotated in a first direction and is moved into a position corresponding to a fully opened mixer position, whereby the heated water temperature is monitored and compared with a threshold value; that on rotation of the control cap in the first direction the second opening is increasingly covered by the control cap and the supply of heater return water to the heater supply is throttled until, in an end position, the addition of return water is minimised; and that on reaching the threshold temperature the control cap is rotated in the opposed second direction of rotation, an increasingly large proportion of return water is introduced into the heater supply through the second opening whilst the flow path from the boiler supply to the heater supply is maintained open, at least initially.

The invention further provides a four-way mixer which is characterised in that a profiled disc with at least three separate openings is fixedly installed in a mixer housing; that a crescent-shaped control cap is slidingly positioned on a flat sealing surface of the profiled disc and is rotatable about an axis of rotation extending at right angles to the seating surface; that the control cap defines a crescent-shaped connecting passage which is so dimensioned that in one rotational position of the control cap it connects the complete opening cross-section of a first profiled disc opening and a cross-sectional sector of the second profiled disc opening whilst another sector of the second opening remains uncovered by the control cap and, in a second rotational position, connects the entire opening cross-section of the first profiled disc opening to a substantially larger proportion of the second profiled disc opening.

This four-way mixer has the advantages referred to above in connection with the apparatus in accordance with the invention for controlling the water flow rate in hot water heating systems. The four-way mixer in accordance with the invention also, however, has the same advantages in other control or regulating apparatus, particularly with regard to easy accessibility, material resistance, sealing and low constructional expense. This is the case above all if the advantages as regards the control technology of mixer/bypass combinations are to be achieved with correspondingly reduced constructional and operational expense. By suitable matching of the opening cross-sections of the openings and their arrangement relative to the rotatable control cap, differing mixing ratios can deliberately be achieved in certain control ranges and thus, in particular, the flow volumes in one mixer branch can be adjusted and remain substantially unaltered in another mixer branch.

The invention will be described below in more detail with reference to an exemplary embodiment illustrated in the drawings. In the drawings:

FIGS. 4A to 4C are different views of a mixer control element;

FIG. 5 is a front elevation of the mixer control element in a setting offset with respect to that of FIG. 4A.

Figure 3:
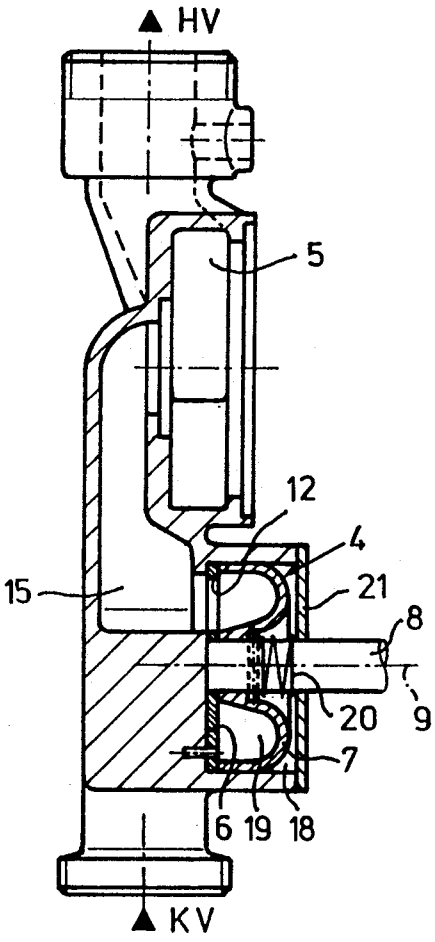
FIG. 3 is a sectional view in the direction of the arrows III—III in FIG. 1 with the mixer control element installed.
Figure 2:
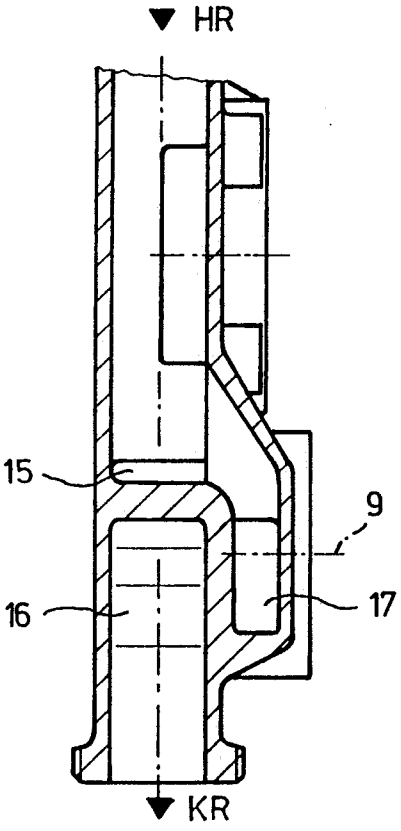
FIG. 2 is a sectional view in the direction of the arrows II—II in FIG. 1.
Figure 1:
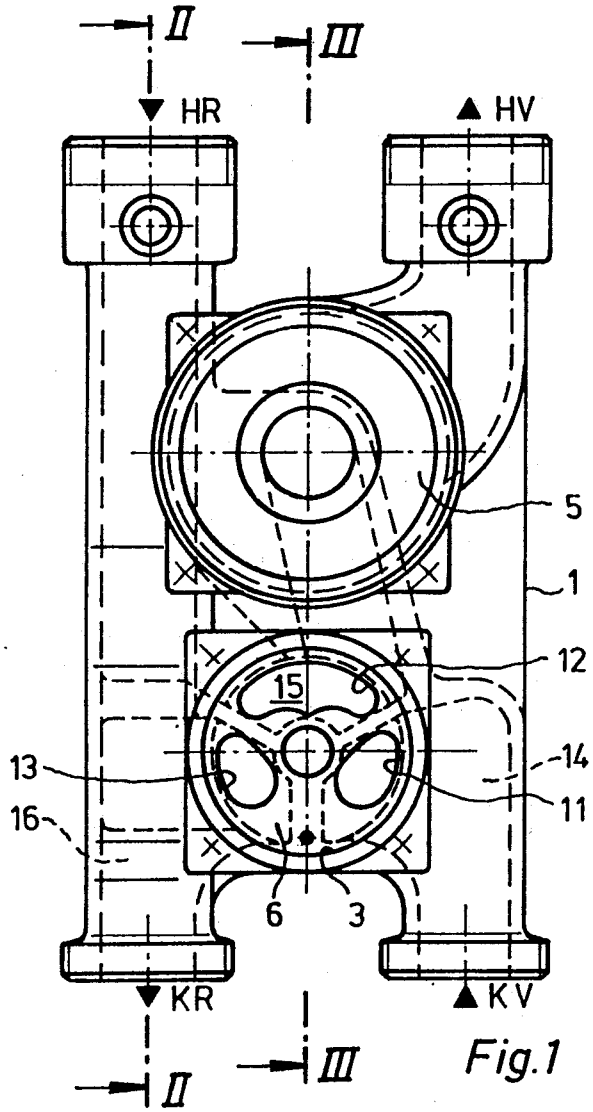
FIG. 1 is a front view of the mixer housing of an exemplary embodiment of the invention with the mixing chamber open and mixer control element removed.

An exemplary embodiment of a four-way mixer with an integrated heating circulation pump is shown in FIGS. 1 to 3. It has connectors for the boiler supply KV, the boiler return KR, the heater supply HV and the heater return HR. The mixer housing 1 includes the mixing chamber 3 which is shown open in FIG. 1 and in which the important components of the mixer control element, which is designated as a whole by 4, are installed.

A circulating pump, which is not shown in the drawings, is operationally installed in a housing recess 5 and incorporated in the heater supply HV.

The four-way mixer is constructed as a cap mixer. It has a profiled disc 6, which is firmly connected to the base wall of the mixer chamber 3, a crescent-shaped control cap 7 extending over a part-circular arc of more than 180° (FIG. 5) and a control shaft 8 which is driven by an actuator and which is rotationally fixedly connected to the control cap 7 and is rotatable relative to the stationary profiled disc about an axis of rotation 9.

The profiled disc 6 has three kidney-shaped holes 11, 12 and 13 which open out into separate flow chambers 14, 15, 16 disposed behind the mixing chamber 3. The first hole 11 together with the chamber 14 associated with it is connected to KV, the second hole 12 with the flow chamber 15 associated with it is connected to HV and the third hole 13 with the flow chamber 16 associated with it is connected to KR. The heater return HR discharges via a radial opening 17 into a flow chamber 18 which forms part of the mixing chamber 3 and externally surrounds the control cap 7. The inner surface of the control cap 7 defines a connecting passage 19 which extends over an arc of somewhat more than 180° and by which the control cap is separated from the flow chamber 18 associated with the heater return HR.

As may be seen in FIG. 3, the control cap 7 is maintained in engagement with the side of the profiled disc 6 directed towards the connecting passage 19 with the aid of a helical spring 20. The helical spring 20 bears against a housing lid 21 which is releasably connected to the housing 1 and seals the mixing chamber 18 from the environment (the seals, particularly at the bushing of the control shaft 8, are of known construction and are not shown in the drawings).

FIGS. 4A, B and C and also 5, which show the important components of the mixer control element 4, will be described below in order to explain the mode of operation of the four-way mixer.

FIG. 4A is a view of the mixer control element 4 in the direction of the axis of rotation 9, shown in a position which corresponds to the operational position at a set mixer angle of about 90°. As stated above, the outer surface of the control cap 7 is acted on by the pressure of the HR water in the chamber 18. The holes 11 to 13 in the profiled disc each communicate with separate flow chambers. In the position illustrated in FIG. 4A, the hole 11 in the profiled disc communicating with KV is connected via the connecting passage 19 to the hole 12 which leads to the heater supply HV. In addition to the boiler supply flow, the second hole 12 also receives returned water in this mixer position from the flow chamber 18. The remainder of the returned water flows into the boiler return whose opening 13 is open to the HR flow chamber 18.

In FIG. 5 the control cap 7 is rotated further in the anticlockwise sense into an end position corresponding to the fully open mixer. As may be seen, in this position the crescent-shaped control cap 7 short-circuits the opening 11 leading to the boiler supply with the opening 12 leading to the heater supply and seals the latter with respect to the HR flow chamber 18 so that no returned water can flow into the heater supply. This position is, as will be further explained below, an end position which can be briefly adopted if the heat requirement in the heating circuit should suddenly increase, for instance at the transition out of the night-time reduction, before the mixer is moved back into the normal operational position again (FIG. 4A (in order not to exceed the threshold temperature in HV). In a large range of mixer positions a volume of returned water which may be controlled to any desired degree of precision can also be added in via the section of the second opening 12 which is left open by the control cap. The control characteristics can thus be adjusted to be comparable to those of the mixer with a bypass disclosed in DE-C-3207427. This occurs successfully with suitable shaping principally of the first and second openings 11 and 12 (the profiles shown in FIGS. 1 and 4A or 5 are to be understood only as exemplary profiles). The desired mixing ratio can be set merely by rotating the control cap 7 with appropriate alteration of the cross-section of the profiles of the openings 11, 12. The rotational stroke of the control cap 7 is somewhat smaller than 180° in the illustrated example.

The choice of materials for the profiled disk 6 and the crescent-shaped control cap 7 is also of importance for a high service life of the mixer control element 4 and friction-free operation thereof. For the first of these (6) an abrasion- and corrosion- resistant material, particularly V2A or a ceramic material is suitable; on the other hand, the control cap 7 comprises a comparatively soft plastics material provided at the flat sealing surface with as optimal as possible sealing properties. Due to frequent control movements the cap material can wear away to a greater or lesser extent in the region of the sealing surface 23; the pressure of the returned medium in the flow chamber 18 together with the compression spring 20 ensure that there is always a flush and sealing engagement whilst compensating for abrasion of the control cap.

Figure 6:
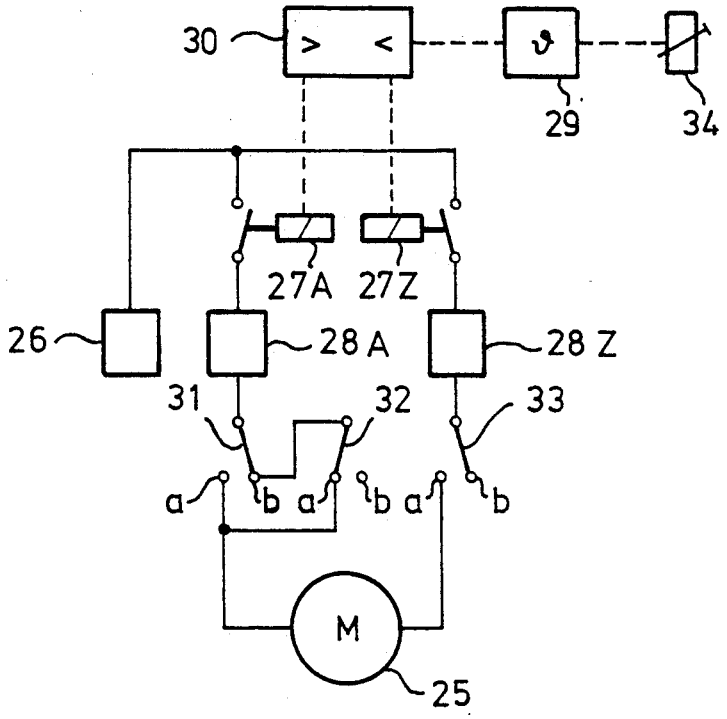
FIG. 6 is a basic circuit diagram of an embodiment of the device controlling the mixer control element.

A schematic circuit diagram of an electrical arrangement for controlling the actuator 25 actuating the control shaft 8 is shown in FIG. 6. The construction and function of the switching arrangement will be described below with reference to the control response of the rotatable control cap 7 in FIGS. 4 and 5.

The actuator 25 is powered by an operational current source 26. Two motor drivers 28A and 28Z, which may be connected via relays 27A and 27Z to the operational current source, determine the direction (A=mixer open; Z=mixer closed) and stroke of the motor control movement transmitted to the control shaft 8. Connected between the drivers 28 and motor 25 is a group of switches with switches 31, 32 and 33. Each switch is constructed as a switch-over switch and can switch between the two positions a and b. The relays 27A and 27Z are switched in dependence on a temperature control device known per se with a three-point sensor 30. A thermostat 34 influenced by the heater supply temperature serves as a threshold value sensor and supplies a threshold signal to the controller 29 when a threshold value of the supply temperature is reached.

The schematic circuit arrangement shown in FIG. 6 will be described below for the typical operational case of the transition from a night-time reduction to daytime operation. The transition begins with a sudden requirement for heat which is communicated via the controller 29, 30 of the arrangement, whereby the relay 27A closes. All the limit switches 31, 32 and 33 are in position a. The actuator 25 then moves out of the limit position corresponding to the night-time reduction (control cap 7 is in the lower half in FIG. 4A, short circuits KR and KV and exposes the second opening 12 to the heater supply for the full return flow). In this switch position the actuator moves rapidly into the control cap position illustrated in FIG. 4A. In this position the boiler supply is completely open to the heater supply and simultaneously the second opening 12 in the profiled disc is partially open to the mixer chamber 12 and thus to the returned water. A cam disc, which is not shown in the drawings and which is coupled to the control shaft 9, actuates the switch 31 on reaching this position and switches it over into position b. The cap disc rotates further in the direction of the limit position shown in FIG. 5 (in the anti-clockwise direction), whereby the return flow is increasingly throttled and accordingly accelerates the heating up.

The thermostat 34 monitors the heater supply temperature and issues a switching command to the controller 29 when a threshold temperature is reached. This can indeed occur before reaching the outermost end position shown in FIG. 5.

The relay 27A is now opened and relay 27Z closed via the three-way regulator 30. Limit switch 33 is in position a. The motor is thus reversed, rotates backwards and is responsible for an increase of the cross-section of the second opening 12 which is open to the mixing chamber 18. An increasing amount of returned water is added into the heater supply. When the value falls below the critical threshold value the relay 27Z opens the associated switch and the driver 28Z is disconnected. Then a three-point control, known per se, occurs in which the actuator 25 rotates the control cap in the clockwise sense or in the anti-clockwise sense when the temperature exceeds or falls below certain threshold temperatures and interrupts the rotational movement again in phases. It is clear from the above description that the control arrangement in accordance with the invention enables a complete utilisation of the controller range and a sensitive control with only a single rotatable control element, namely the control cap 8. The operational expense is minimised, the service life comparatively substantially increased and the reliability accordingly improved.

Numerous modifications are possible within the scope of the inventive concept. Thus the configuration of the cap, the construction and support points of the spring, the construction of the sealing surface between the cap and profiled disc 6 and, above all, the shape, arrangement and number of the openings used can be varied in order to adapt to the constructional shapes of the housing and/or to desired control characteristics.

I claim:

1. Four-way mixing device for controlling the flow rate between two fluid circuits, said mixing device including:

a housing with a mixing chamber and four separate housing connections; a stationary profiled disc installed in said mixing chamber of the mixer housing and having a substantially flat seating surface and at least three separate openings, whereby a first opening is connected to a first housing connection, a second opening is connected to a second housing connection and the third opening is connected to a third housing connection;

a control cap having a sliding fit on said seating surface of the profiled disc and being rotatable about an axis of rotation at right angles to the seating surface, said cap defining a substantially crescent-shaped connecting passage which is open to the seating surface of the profiled disc and is so dimensioned that, in a first rotational position (FIG. 4*a*) of said control cap, it connects the entire opening cross-section of said first profiled disc opening and a first cross-sectional sector of the second opening whilst another section of the second opening remains uncovered by the cap and, in a second rotational position (FIG. 5), it connects the entire opening cross-section of the first profiled disc opening with a larger cross-sectional sector of the second opening;

said control cap having an outer side which is directed away from the connecting passage and which is arranged in a chamber communicating with the fourth housing connection.

2. Four-way mixing device as claimed in claim 1 further including means for resiliently urging said control cap against the flat seating surface of the profiled disc.

3. Four-way mixing device as claimed in claim 2, wherein the three profiled disc openings communicate with three separate housing chambers on a side of the profiled disc directed away from the seating surface.

4. Four-way mixing device as claimed in claim 3, wherein the profiled disc consists of a substantially abrasion- and corrosion- resistant material.

5. Four-way mixing device as claimed in claim 4, wherein said substantially abrasion- and corrosion-resistant material is selected from the material group comprising corrosion-resistant steel alloys, ceramic materials and a mixture of the said materials.

6. Four-way mixing device as claimed in claim 5, wherein the control cap consists of a relatively soft plastics material.

7. Four-way mixing device as claimed in claim 1, wherein the cross-sectional area of the second profiled disc opening is about 50 to 150% larger than that of the first profiled disc opening.

8. Four-way mixing device as claimed in claim 7, wherein the cross-sectional area of the second profiled disc opening is 80 to 100% larger than that of the first profiled disc opening.

9. Four-way mixing device as claimed in claim 2, wherein the urging means are so constructed that the control cap is pressed against its seating surface on the profiled disc with a force which is only slightly larger than its own weight.

10. Four-way mixing device as claimed in claim 1, wherein the profiled disc openings are arranged at a mutual angular spacing on a circle about the axis of rotation of the control cap.

11. An apparatus for controlling the water flow rate between a boiler circuit and a heater circuit in hot water heating systems, said boiler circuit having a boiler supply and a boiler return and said heater circuit having a heater supply and a heater return, said apparatus comprising:

a housing;

a four-way mixing means disposed in said housing, said four-way mixing means including a profiled disc fixedly arranged in said housing and having at least three separate openings of which a first opening is connected to said boiler supply, a second opening is connected to said heater supply and a third opening is connected to said boiler return, a rotatable control cap having a sealing surface for sealingly engaging a substantially flat surface of said profiled disc, said control cap having an outer surface exposed to the water pressure in said heater return and having an inner surface for defining a connecting passage, said control cap having a limited rotational movement and extending over an angular region of said profiled disc, is rotated to short circuit said first opening connected to the boiler supply with said second opening leading to said heater supply and simultaneously exposing a variable proportion of an opening cross-section of said second opening to returned water flowing into said housing through said heater return; and a control device for controlling the position of said control cap of said mixing means, whereby when said mixing means is in a fully open position a variable amount of returned water can be added into the heater supply.

12. The apparatus as claimed in claim 11 wherein said housing includes three separate housing chambers disposed on one side of said profiled disc and communicating each with a different one of said three disc openings, said housing further includes a fourth chamber for receiving that rotatable control cap, said fourth chamber communicating with said heater return.

13. The apparatus as claimed in claim 12 wherein the rotational movement of said control cap is limited to a rotational angle of about 120° and having a first end position and a second end position which are opposite to each other, and in said first end position said boiler supply is fully open to the heater supply via the connecting passage but simultaneously a second opening cross-section remains as a flow opening to said fourth chamber.

14. The apparatus as claimed in claim 12 wherein the openings have at least partially kidney-shaped opening cross-sections.

15. The apparatus as claimed in claim 11 wherein said connecting passage extends over an arc length in the range of 160°–200°.

16. The apparatus as claimed in claim 13, wherein said control cap when set in said first end position separates said first and second openings from said heater return and short circuits said first and second openings via aid connecting passage while the heater return water flows through said third opening.

17. The apparatus as claimed in claim 11 wherein said profiled disc is constructed of a non-abrasive, non-corrosive material including hardened steel, alloyed steel, and ceramic material.

18. The apparatus as claimed in claim 11, further comprising reversible actuator means for driving said control cap in response to said control device in such a manner that when there is a suddenly increasing heating temperature requirement, said reversible actuator means moves the control cap out of a first end position in the direction towards a second end position in which the heater supply is short circuited with the boiler supply and the flow cross-section between the heater return and said second opening leading to the heater supply is minimal and, on reaching an upper threshold temperature in the heater supply, rotates in the opposed direction into a working position in which the second opening is partially open to the heater return and heater return water is mixed into the boiler supply water supplied via said connecting passage.

19. The apparatus as claimed in claim 18 wherein the temperature of water flowing through said heater supply is monitored by thermostat, said control device having a three-point control arrangement with switches for switching said actuator means on and off and for reversing the direction of rotation of said control cap and wherein said three-point control arrangement may be switched-over by said thermostat.

20. The apparatus as claimed in claim 19 wherein a switch arrangement is provided in a circuit for supplying electrical current to said actuator means, said switch arrangement being actuated by a cam disc in response to the position of said control cap.

21. The apparatus as claimed in claim 15 wherein the control cap is resiliently biased against the profiled disc.

22. The apparatus as claimed in claim 21 wherein said control cap consists of plastics material which is softer than the material of said profiled disc.

23. In an apparatus for controlling the water flow rates in a boiler circuit and a heater circuit of low temperature heating systems, said apparatus comprising a four-way mixer having a stationary disc with separate openings and a rotatable control cap cooperating with said stationary disc, a method of operating said control cap for controlling said water flow rates, said method comprising the following steps:

determining a suddenly increased heat requirement;

rotating said control cap in a first direction towards an end position corresponding to a fully opened mixer position when a sudden increased heat requirement is detected, while monitoring the temperature of the heated water and comparing said temperature with a threshold value;

increasingly covering the second opening by rotating said control cap in said first direction and throttling thereby the supply of heater return water to the heater supply until, in said end position, the addition of return water is minimized; and rotating said control cap in an opposite second direction of rotation once said threshold temperature value is reached thereby introducing an increasingly large proportion of returned water into the heater supply through the second opening whilst the flow path from the boiler supply to the heater supply is at least initially maintained open.

24. The apparatus as claimed in claim 23 wherein the profiles of the first and second openings are so selected and matched to the sizes and form of the control cap that an approximately linear control characteristic is produced along with a large control range.

25. The apparatus as claimed in claim 23, wherein said control cap is pressed against a seating surface on the profiled disc with a force which is only slightly larger than the weight of said control cap.

* * * * *